US011542699B2

(12) United States Patent
Schrant et al.

(10) Patent No.: US 11,542,699 B2
(45) Date of Patent: Jan. 3, 2023

(54) COMMODE BIDET

(71) Applicant: Commodo, LLC, Maize, KS (US)

(72) Inventors: Tyler Andrew Schrant, Maize, KS (US); Andrew Leon Pick, Middleton, WI (US)

(73) Assignee: Commodo, LLC, Maize, KS (US)

( * ) Notice: Subject to any disclaimer, the term of this patent is extended or adjusted under 35 U.S.C. 154(b) by 0 days.

(21) Appl. No.: 17/205,481

(22) Filed: Mar. 18, 2021

(65) Prior Publication Data

US 2021/0293013 A1 Sep. 23, 2021

Related U.S. Application Data

(60) Provisional application No. 62/991,280, filed on Mar. 18, 2020.

(51) Int. Cl.

| | |
|---|---|
| ***E03D 9/08*** | (2006.01) |
| ***A47K 11/06*** | (2006.01) |
| ***A47K 17/02*** | (2006.01) |

(52) U.S. Cl.

CPC ..... *E03D 9/08* (2013.01); *A47K 11/06* (2013.01); *A47K 17/026* (2013.01)

(58) Field of Classification Search

CPC ..... E03D 9/08

USPC ..... 4/443, 444, 447, 445, 420

See application file for complete search history.

(56) References Cited

U.S. PATENT DOCUMENTS

| | | | | |
|---|---|---|---|---|
| 5,335,855 | A * | 8/1994 | Borod | B05B 1/1672 239/152 |
| 5,685,028 | A * | 11/1997 | Miller | E03D 9/085 604/259 |
| 5,754,988 | A * | 5/1998 | Presa | E03D 9/085 4/443 |
| 6,843,432 | B1 * | 1/2005 | Philpott | A47K 7/08 239/289 |
| 7,543,339 | B1 * | 6/2009 | Harris | E03D 1/01 4/445 |
| 9,194,115 | B1 * | 11/2015 | Green | E03D 13/00 |
| 9,594,500 | B2 * | 3/2017 | Clements | G06V 40/168 |
| 10,076,215 | B1 * | 9/2018 | Quay | A47K 3/122 |
| D936,212 | S * | 11/2021 | Hopp | A61M 3/02 D24/115 |
| 2007/0204395 | A1 * | 9/2007 | Scalzi | E03D 9/08 4/420.4 |
| 2009/0043267 | A1 * | 2/2009 | Jackson | A61M 3/025 604/275 |
| 2009/0121042 | A1 * | 5/2009 | Mitry | E03D 9/085 239/61 |
| 2011/0113545 | A1 * | 5/2011 | Driessen | B60R 15/00 4/476 |
| 2011/0302709 | A1 * | 12/2011 | Taylor | A61M 3/0216 4/443 |
| 2012/0297529 | A1 * | 11/2012 | Bowcutt | A61M 3/02 4/448 |
| 2013/0079733 | A1 * | 3/2013 | Burt | B05B 17/0607 239/102.1 |

(Continued)

*Primary Examiner* — Lori L Baker

(74) *Attorney, Agent, or Firm* — Boardman & Clark LLP

(57) ABSTRACT

A bidet for a portable commode. The bidet can include a sprayer coupled to a bucket of the portable commode, a water basin fluidly coupled to the sprayer, an electrically motorized pump disposed in the water basin to pump water from the basin to the sprayer, and a control module to control a flow of water from the basin to the sprayer.

18 Claims, 11 Drawing Sheets

(56) References Cited

U.S. PATENT DOCUMENTS

| | | | | |
|---|---|---|---|---|
| 2013/0091626 | A1* | 4/2013 | Al-Jafar | E03D 5/00 4/321 |
| 2013/0145537 | A1* | 6/2013 | Al-Jafar | A61G 5/1002 4/420.5 |
| 2014/0096316 | A1* | 4/2014 | Wu | E03D 9/085 4/443 |
| 2015/0143625 | A1* | 5/2015 | Veurink | A47K 3/281 4/448 |
| 2015/0313424 | A1* | 11/2015 | Mas Lara | E03D 9/085 4/443 |
| 2017/0127888 | A1* | 5/2017 | Culton, Sr. | A61M 3/0262 |
| 2018/0266091 | A1* | 9/2018 | Schmucker | E03D 9/08 |
| 2019/0161952 | A1* | 5/2019 | Muhi Deen | E03D 9/085 |
| 2021/0338022 | A1* | 11/2021 | Roff | A47K 17/028 |
| 2021/0372111 | A1* | 12/2021 | Dickinson | A61H 35/00 |

* cited by examiner

COMMODE BIDET

CROSS-REFERENCE TO RELATED APPLICATIONS

This application claims the benefit of U.S. Provisional Patent Application No. 62/991,280, filed Mar. 18, 2020, entitled "COMMODE BIDET," the entire contents of which is hereby incorporated by reference herein in its entirety.

BACKGROUND

Portable commodes are often used in hospitals and nursing homes with low-mobility patients. A low-mobility patient may have a portable commode placed adjacent to their bed to enable the patient to use the commode with little assistance. Other low-mobility patients may require assistance to use the portable commode. In either case, the low-mobility patient may struggle in cleaning their own perineal area. Assistance is often required to ensure the perineal area is sufficiently clean.

Bidets are a known solution to cleaning the perineal area. Typically, bidets are fixedly installed and incorporated into the water supply lines of a toilet system, often positioned adjacent a toilet for cleaning the perineal area of the body. The flow, temperature and pressure of water flow can be regulated for discharge from nozzles mounted on the front and/or rear. Unfortunately, installed systems have various drawbacks for individuals in hospitals and nursing homes as they require the user to be mobile, and require the assistance of a caregiver.

Retrofit devices are also known, however, such devices typically require complex attachment mechanisms and still must attach to an existing toilet. Portable wand type devices are also known, however such devices require the user to be able to operate the device and have sufficient mobility to hold and move the wand, as well as operate the water spray.

Accordingly, a need exists for a commode bidet that provides a user of limited mobility the ability to use the device with minimal assistance, and which is adaptable to users of differing levels of mobility.

SUMMARY

An example bidet for a portable commode comprising includes a sprayer coupled to a bucket of the portable commode. A water basin is fluidly coupled to the sprayer. An electrically motorized pump is positioned within the water basin to pump water from the basin to the sprayer. A control module controls a flow of water from the basin to the sprayer.

An example sprayer that may be used with a bidet for a portable commode includes a clip to attach the sprayer to an edge of a bucket of a portable commode. The sprayer wand extends into the bucket of the portable commode. The sprayer wand has an outlet for water.

BRIEF DESCRIPTION OF THE DRAWINGS

Various examples of embodiments of the systems, devices, and methods according to this invention will be described in detail, with reference to the following figures.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring to the Figures, a bidet for a portable commode is disclosed. The bidet for a commode generally comprises a bidet sprayer and a portable water tank assembly coupleable to a portable commode. A control housing assembly is attached to the water tank assembly. An electrically motorized pump is positioned in the water tank assembly and pumps water from the water tank to the bidet sprayer. The electrically motorized pump has an electronic control system positioned in the control housing assembly. The electronic control system is configured to activate the pumping mechanism. The bidet sprayer is attached to a commode waste bucket.

Figure 1:
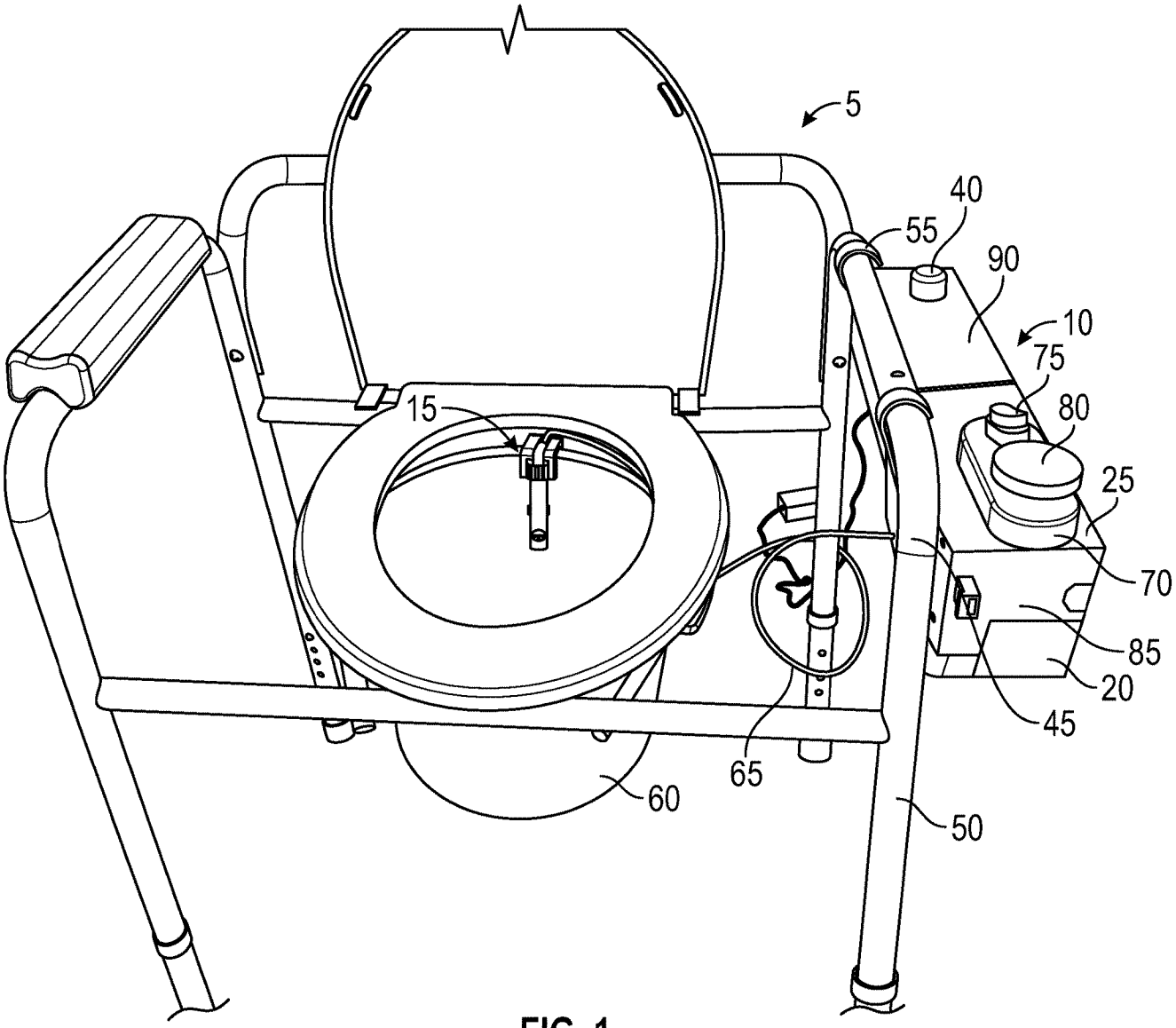
FIG. 1 depicts an example portable commode and an example commode bidet that may be used with the portable commode.

FIG. 1 depicts an example commode 5 for use with an example commode bidet 10 as described herein. The example commode 5 is a portable commode. More specifically, the example commode 5 may be designed for use with low-mobility users, such as patients in nursing homes or hospitals. The example commode bidet 10 generally includes a bidet sprayer assembly 15, a portable water tank assembly 20, and a control housing assembly 25. Additionally, the example commode bidet 10 includes an electrically motorized pump 30 (shown in FIG. 4) to move water from the portable water tank assembly 20 to the bidet sprayer 15. The motorized pump 30 is controlled using an electronic control system 35 positioned within the control housing assembly 25. To facilitate use in multiple environments, the example motorized pump 30 of the commode bidet 10 may be battery powered or may be powered via an AC adapter 40 that is plugged into a wall outlet. For example, the AC adapter 40 may be used with the commode bidet 10 in an area where an outlet is readily available and easy to access, such as a patient's room. Alternatively, battery power may be used when an outlet is not available or not easy to access. Additionally or alternatively, the AC adapter may be an AC or DC adapter. In some examples, the AC or DC adapter may be coupled to an external battery as a power source.

The example commode bidet 10 includes a water tank assembly 20 and a control housing assembly 25 that can be attached to an armrest portion 45 of a frame 50 of the example commode 5. The example water tank assembly 20 and control housing assembly 25 may be attached to the armrest portion 45 on either side (e.g., left side, right side) of the frame 50. The example construction of FIG. 1 depicts the water tank assembly 20 and control housing assembly 25 positioned on the left side for left-handed operation. However, the example water tank assembly 20 and control housing assembly 25 may instead be positioned the right side for right-handed operation. Alternatively, the control housing assembly 25 or bidet 10 may be provided with a static or fixed electronic control and/or in some examples a static or fixed power cord or power port. As a static unit, the bidet 10 is formed as only a right side or only a left side unit, in which case the control is not changeable or not removable. However, the control housing or bidet could be made functional for left- or right-hand operation, e.g., may optionally be reversible, by attachment mechanisms provided on either side of the device. Alternatively, separate left-handed and right-handed bidets may be provided.

In the illustrated construction, the water tank 20 and control housing assemblies 25 are attached to the frame 50 using one or more attachment mechanisms or straps 55. Particularly, the straps 55 may be Velcro straps. Alternatively, other types of fasteners may be used to secure the straps 55, such as ties, snaps or buckles. In other examples, a different fastening mechanism may be used to attach the water tank 20 and control housing assemblies 25 to the frame 50, such as hooks, clips, or clamps that allow the water tank assembly 20 and control housing assembly 25 to hang from the frame 50. While attaching the commode bidet 10 to the frame 50 of the commode 5 is the preferred use and increases the portability and ease of use of the commode 5 with an attached commode bidet 10, the water tank assembly 20 and control housing assembly 25 may instead be attached or placed on a nearby piece of furniture, for example.

The bidet sprayer 15 (e.g., nozzle) of the example commode bidet 10 attached to a bucket 60 of the commode 5. As is typical with a sprayer of a bidet, the example sprayer 15 is attached to a rear edge of the bucket 60. A hose 65 or flexible tube extends between the control housing assembly 25 and the sprayer 15 to convey water to the sprayer 15. In other examples, other means of conveying fluid may be used instead, such as a series of pipes. A control module 70 is coupled to the control housing assembly 25 and positioned within reach of the user to allow the user to control the water flow through the sprayer 15. The control module 70 includes a switch 75 to allow the user to turn the flow of water on and off. A dial 80 or other gradual or incremental control mechanism is included on the control module 70 to allow the user to adjust a pressure of the flow of water through the sprayer 15. One or more markings may be provided on the dial 80 (such as but not limited to low, medium, high, and various hash marks) to identify the pressure selected. Water pressure may be controlled or adjusted though a regulator. Lights, tactile, and audible signals may also be used to identify the selection to the user. A selection function or switch may also be provided for control of the temperature (not shown). A heater, thermocouple, and/or other mechanism may be provided in the tank 20 or fluid supply line for use in controlling the temperature of the water or fluid delivered by the device.

The control module 70 and the AC adapter 40 may be coupled to the control housing 25 in identical ports such that the control module 70 and AC adapter 40 are interchangeable. This allows the control module 70 to be positioned adjacent a front edge 85 of the control housing assembly 25 so that the control module 70 is easily operable by the user. Additionally, using identical ports for the AC adapter 40 and the control module 70 facilitates configurations that accommodate left or right-handed operation, depending on which armrest 45 of the frame 50 the control housing 25 is attached. Thus, a low mobility user is able to use the example commode bidet 10 to clean their perineal region with little or no assistance.

FIGS. 2-5 depict the example water tank assembly and control housing assembly 25 for use with the example commode bidet 10 of FIG. 1. The example control housing assembly 25 is coupled to a top 90 of the example water tank assembly 20. However, one of skill in the art will appreciate that the physical locations of these two components may be varied. For example, the control housing assembly 25 may be positioned on a side, a bottom, or within the water tank assembly 20. The example water tank assembly 20 includes an example water basin 95. The example water basin 95 in the illustrated figure is transparent, but in other example constructions, the water basin 95 may be made of an opaque material. Additionally, in the example construction, the water basin 95 is plastic, but other materials may be used. The example water basin 95 may include integrated features to facilitate coupling the water basin 95 to the control housing assembly 25 or positioning of the electrically motorized pump 30, such as rails 100 discussed in more detail below. Alternatively, these features may be fastened to the basin 95 using any type of mechanical fastener or adhesive.

The example water tank assembly 20 also includes the electrically motorized pump 30 (shown in FIG. 4), which is disposed within the water basin 95. The pump and/or motor may be submerged or otherwise provided in the water tank 20. Alternatively, the pump and/or motor may be provided in the control housing 25 or may be provided external to the basin 95. The motorized pump 30 pumps water from the basin 95 to the sprayer 15. A hose, tube, or pipe (not shown) extends between an outlet of the motorized pump 30 and a fluid connector (shown in FIG. 7) and is fluidly coupled to the hose 65 extending between the example control housing assembly 25 and the sprayer 15. In some examples, a level sensor 105 is also positioned within the basin 95 such that the level sensor 105 detects when a level of the water in the basin 95 is too low to operate the pump 30. If the level sensor 105 determines that the water level is too low, the electronic control system 35 (e.g., controller) disposed within the control housing assembly 25 may prevent operation of the motorized pump 30. In one or more examples of embodiments, the motorized pump 30 may be provided with an integrated auto shut off, for example, if too much water is drawn from the basin 95 so as to preserve pump integrity and/or for safety. In the illustrated construction, the motorized pump 30 and level sensor 105 are held in place adjacent a bottom 110 of the basin 95 using a bracket 115 having two side arms or supports 120 and one or more platforms or lateral supports 125. Any other brackets or suitable means of fixing the motorized pump 30 and level sensor 105 in place within the basin 95 may be used instead.

The example control housing assembly 25 is coupled to the example water tank assembly 20. Alternatively, the control housing assembly 25 is integral with the example water tank assembly 20. In some example constructions, the control housing assembly 25 is made of multiple components that fit together (e.g., snap fit, press fit). Additionally, some components may be secured on the control housing assembly 25 using fasteners. For example, one or more back covers 130 may be secured using screws or bolts 135. The example back cover 130 includes a plurality of attachment 137 points to which the attachment mechanisms 55 may be occupied.

Figure 4:
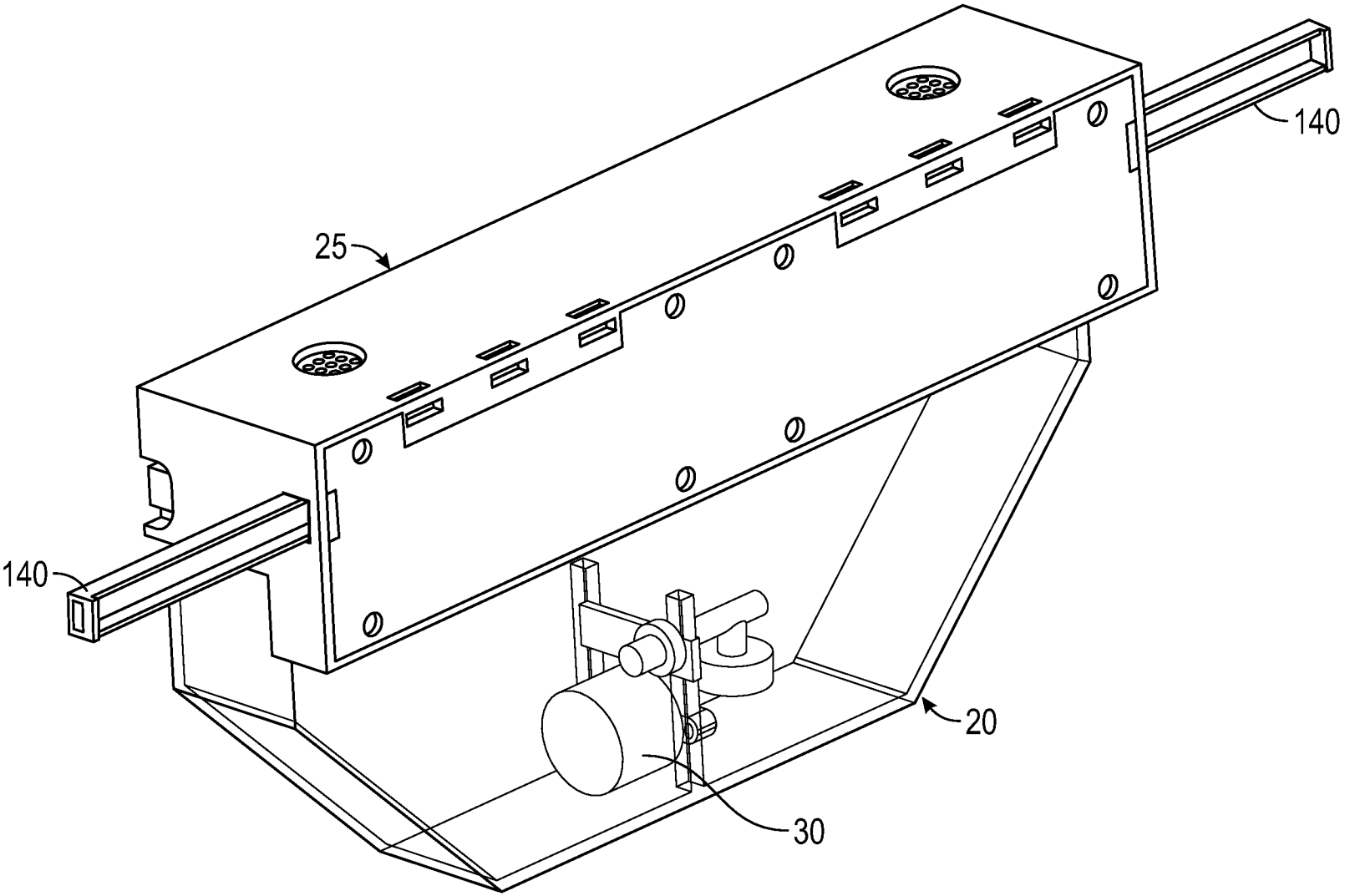
FIG. 4 depicts example extension arms that may be used with the example water tank and control housing assembly of FIGS. 2 and 3 to attach the example control housing assembly to a large portable commode.
Figure 8:
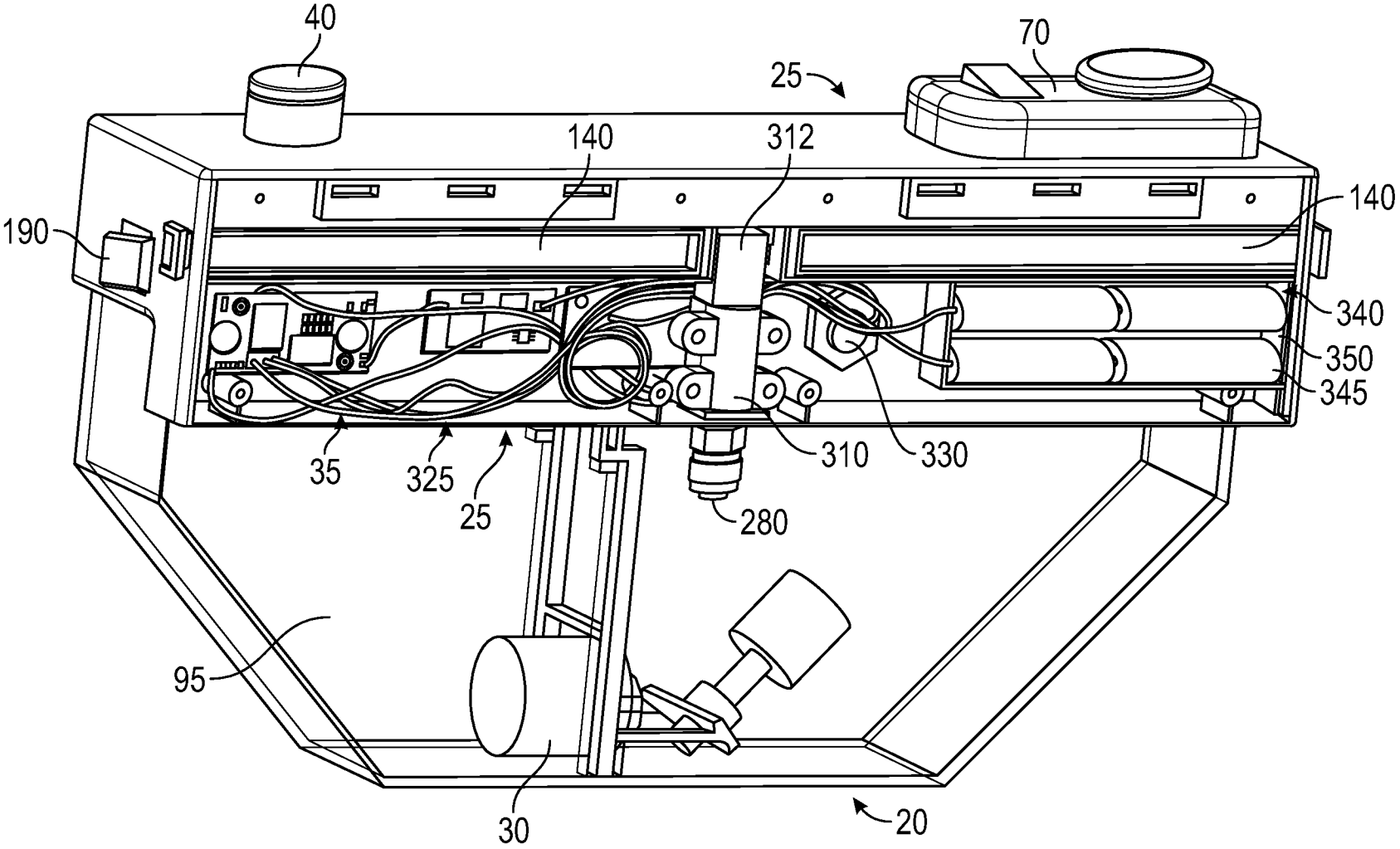
FIG. 8 depicts the example water tank and control housing assembly of FIGS. 2-5 with a back cover of the control housing assembly removed.
Figure 10:
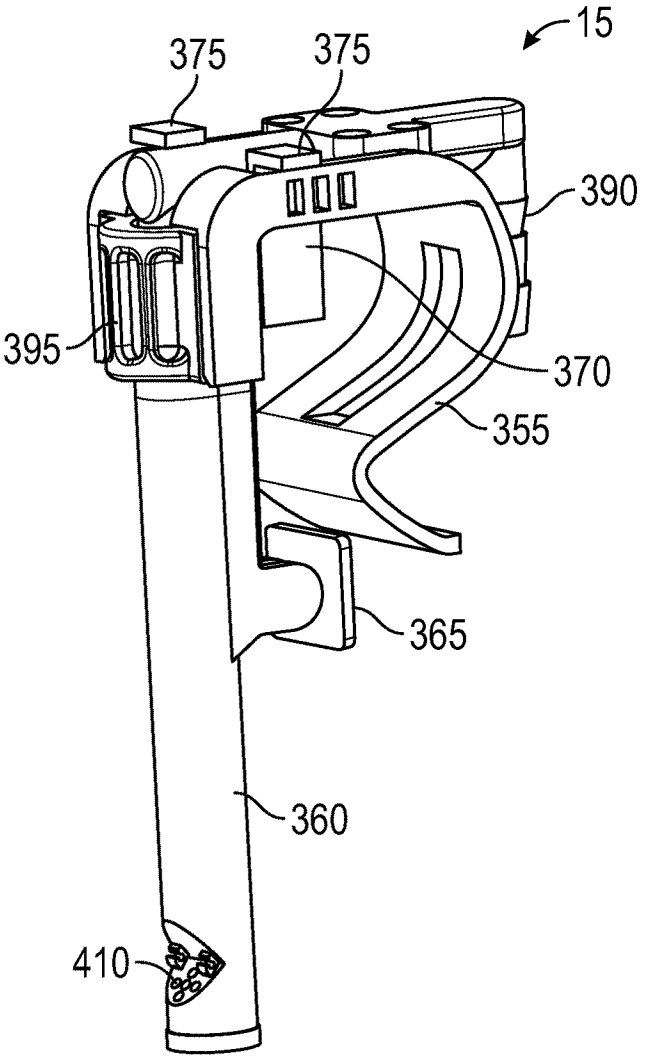
FIG. 10 depicts a more detailed view of the example nozzle of FIG. 9.

As shown in FIG. 4, the example control housing assembly 25 includes extendable support arms 140 (e.g., frame arms, extension arms). The example support arms 140 extend from either end 145 of the control assembly housing 25 and may be used to support the water tank assembly 20 by preventing the water tank assembly 20 from swinging when coupled to the frame 50 of a commode 5. The support arms 140 may be used when coupled to any commode 5 for additional support, but are particularly useful when the example tank assembly 20 is coupled to a large commode. The example support arms 140 slide in and out of a corresponding cavity 150 in the example control housing assembly 25. When the support arms 140 are in the most retracted position, an end 155 of each support arm 140 protrudes from the control housing assembly 25 to enable a user to grab the end 155 and pull on the support arm 140 to extend the support arm 140. FIG. 8 depicts the support arms 140 within the control housing assembly 25.

Figure 2:
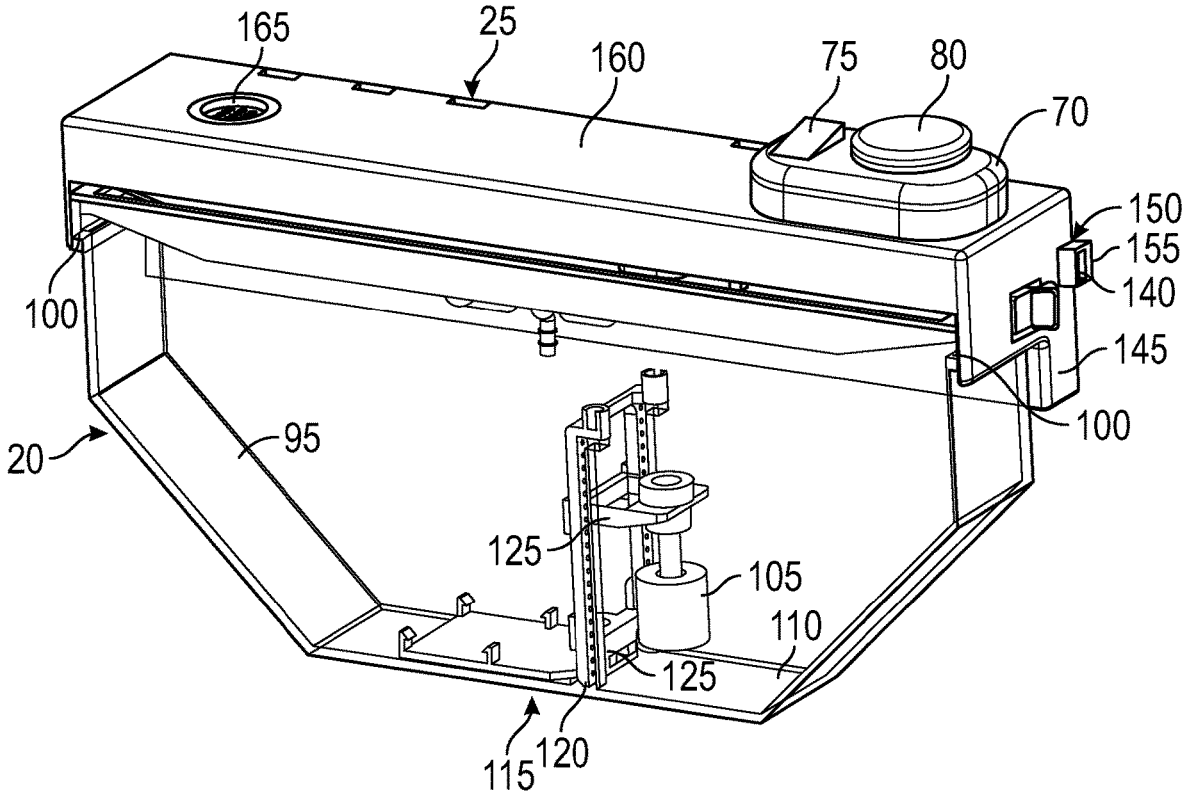
FIG. 2 depicts an example water tank and control housing assembly of the example commode bidet of FIG. 1.
Figure 3:
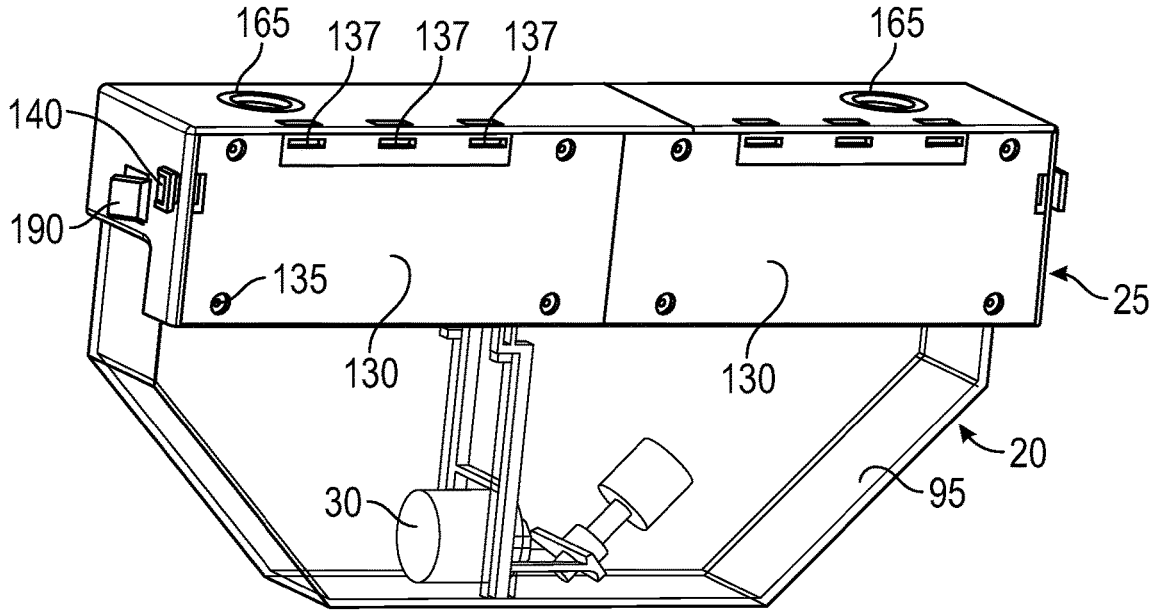
FIG. 3 depicts an alternative view of the example water tank and control housing assembly of FIG. 2.
Figure 5:
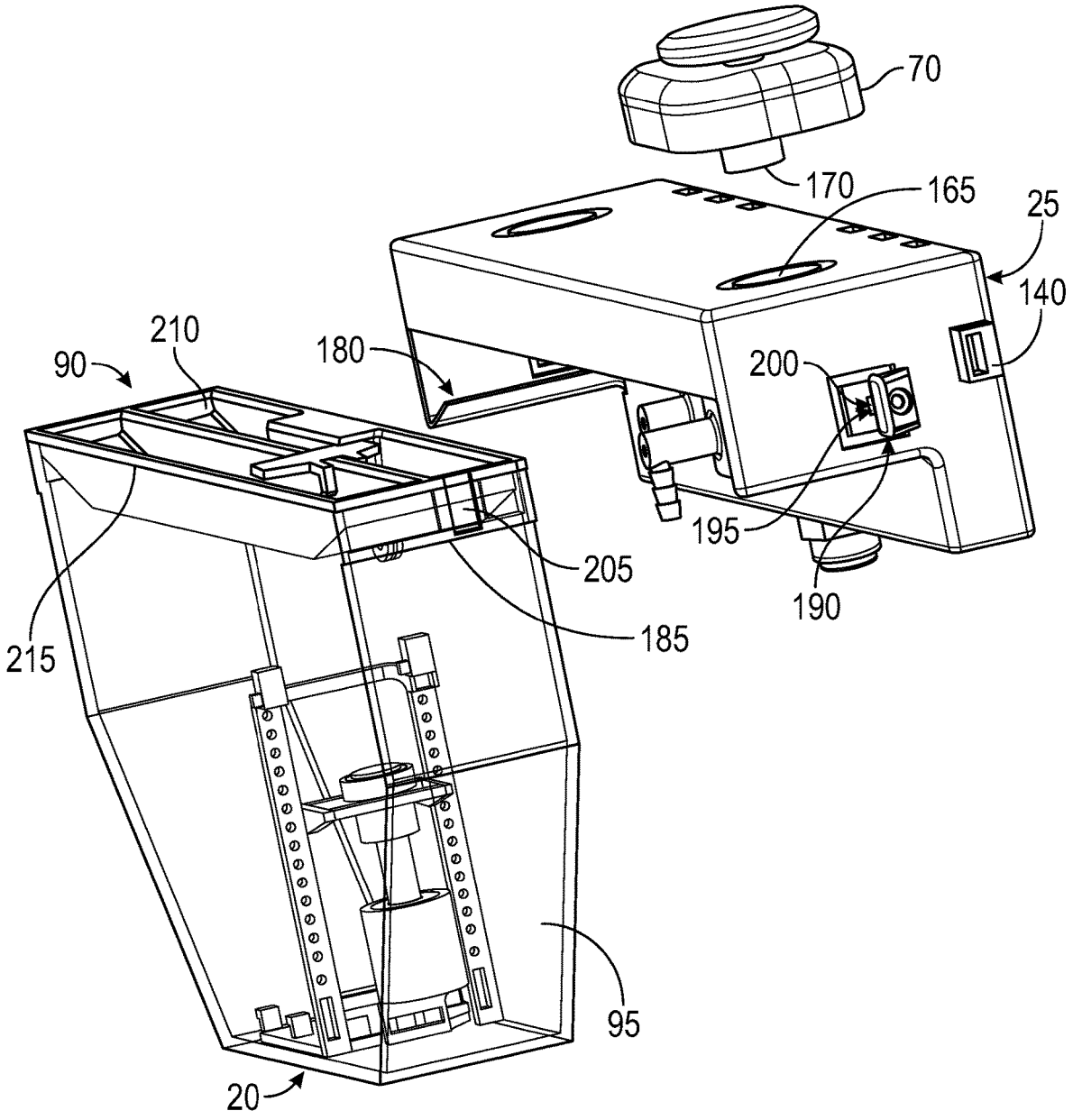
FIG. 5 depicts a partially exploded view of the example water tank and control housing assembly of FIGS. 2-4.

As depicted in FIGS. 2 and 5, the example control module 70 is coupled to a top 160 of the control housing assembly 25 via a port 165. As discussed in connection with FIG. 1, the ports 165 are substantially identical so that the control module 70 can be placed in either port 165. When the bidet 10 is using an AC power source, the AC adapter 40 is coupled to the port 165 not being used for the control module 70. As shown in FIG. 5, the example control module 70 includes a protruding plug 170 corresponding to the ports 165 on top 160 of the control housing assembly 25 so that the control module 70 can easily be switched from one port 165 to the other. The AC adapter 40 includes a similar plug to allow for easy re-configuration of the placement of the AC adapter 40 and control module 70.

As shown in FIG. 2-5, the example control housing assembly 25 is coupled to a top 90 of the example water tank assembly 20. FIG. 5 depicts the example control housing assembly 25 removed from the example water tank assembly 20. The control housing assembly 25 includes channels 180 that slidably engage rails 185 of the basin 95. The example rails 185 may be built-in to the basin 95 (e.g., using injection molding, 3-D printing, etc.). Alternatively, the rails 185 may be attached to the basin 95 using any suitable attaching means. The water tank assembly 20 may be locked in place relative to the control housing assembly 25 using locking mechanisms 190 positioned on the control housing assembly 25 adjacent to the channels 180. The locking mechanism 190 may include a protrusion 195 extending through an opening 200 of the control housing assembly 25. The protrusion 195 contacts a portion of the rail 185 (e.g., a lip 205, a groove, a cutout, etc.) such that when the protrusion 195 is engaged with the lip 205, sliding movement between the rails 185 and channels 180 is prevented. The locking mechanisms 190 may be spring loaded (e.g., biased) toward the locked position and require user engagement to unlock the mechanism 190 to allow removal of the tank assembly 20 from the control housing assembly 25 to, for example, refill or clean the basin 95.

Figure 6:
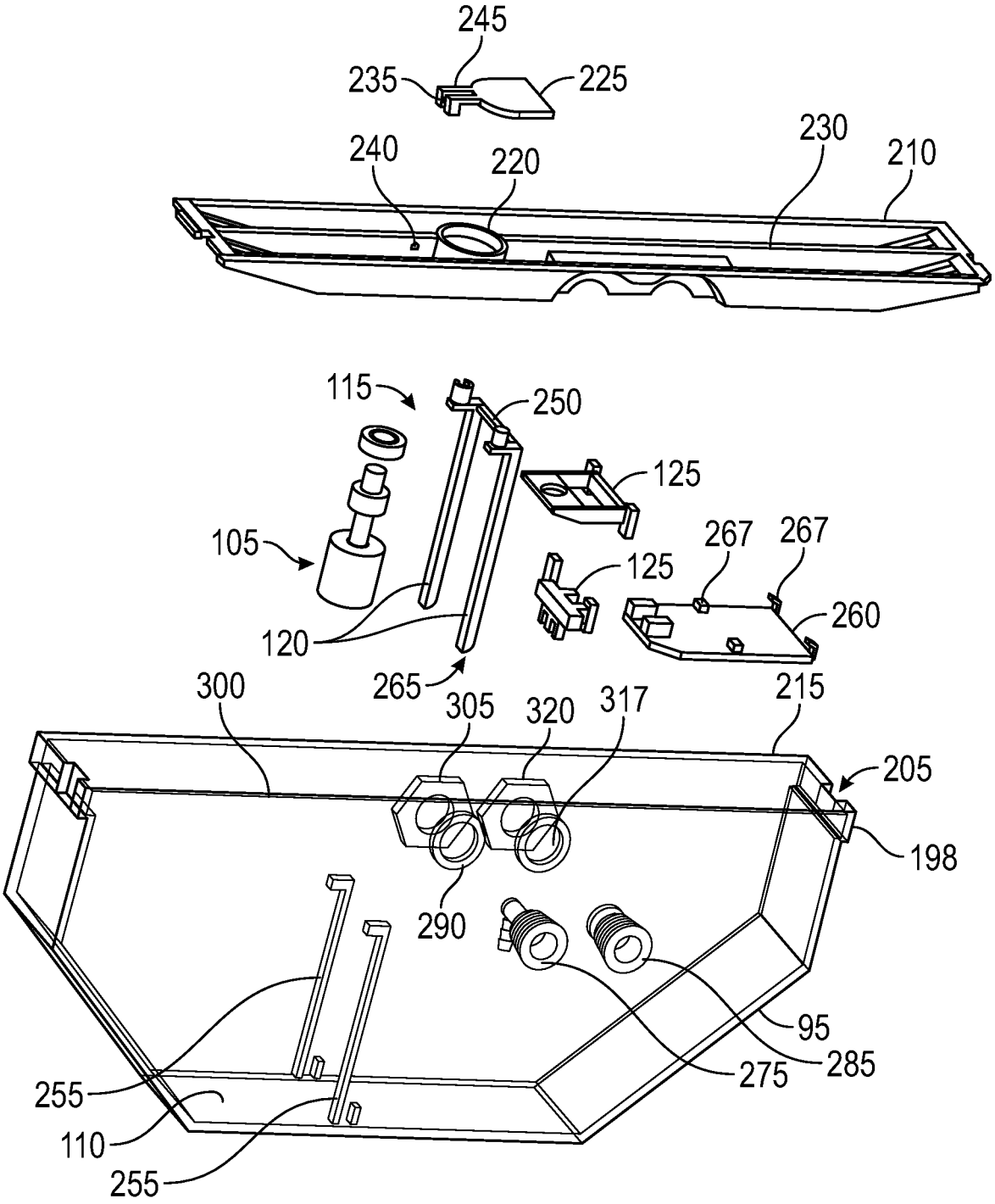
FIG. 6 depicts an exploded view of the example water tank assembly of FIGS. 2-5.

FIG. 6 depicts a partial exploded view of the example tank assembly 20. The example water tank assembly 20 includes a top cover 210. The example top cover 210 may be set or snapped in place at a top edge 215 of the basin 95. The top cover 210 may be removable to allow for easy refill of the water basin 95 and cleaning. Additionally or alternatively, the top cover 210 may include an opening 220 for refilling the basin 95. In some examples where the top cover 210 includes an opening 220, the top cover 210 may be fixed or permanently attached to the basin 95. A rotatable cover 225 or flap may be coupled to the top cover 210 adjacent to the opening 220 to close or seal the opening 220 when the water tank assembly 20 is coupled to the control housing assembly 25. The example rotatable cover 225 may be coupled to a rib 230 of the top cover 210 using a combination of detents 235 and indents 240. For example, the rotatable flap 225 may include two arms 245 extending on either side of the rib 230 that include detents 235 and the rib 230 may include indents 240 on either side in a location corresponding to the detents 235, which allows the rotatable flap 225 to be rotatably attached to the top cover 210. In some example constructions, the flap 225 may be slidable, rotatable in a different plane, or may instead be a plug with a seal or O-ring.

The example basin 95 includes the bracket 115 disposed within the basin 95 to hold the motorized pump 30 and level sensor 105 in place. The example bracket 115 depicted in FIG. 6 is just one construction that may be used, and any suitable bracket that holds the motorized pump 30 and/or level sensor 105 in place may be used instead. In the illustrated construction, the bracket 115 includes a frame 250 having two side supports 120. The two side supports 120 correspond to a ledge 255 of lip of the basin 95 (e.g., an integral ledge) and fit along the ledge 255 so that the side supports 120 are fixed in place within the basin 95. The bracket 115 also includes a base support 260 that sits on a bottom surface 110 of the basin 95 and is coupled to the side supports 120 adjacent a bottom end 265 of the side supports 120. The base support 260 includes clips 267 to couple to the motorized pump 30 to hold the pump 30 in place. Lateral supports 125 may be coupled at different heights along the side supports 120. The lateral supports 125 may be coupled to a level sensor 105 to fix the level sensor 105 in place. Each of the components of the bracket 115 may be snap-fit or press-fit together and with the motorized pump 30 and/or the level sensor 105.

The water tank assembly 20 includes a first fluid connector 275 and an electrical connector 285. In the illustrated construction, the first fluid connector 275 is positioned on a sidewall 300 of the basin 95. The example first fluid connector 275 is aligned with a first hole or aperture 290 on the sidewall 300 of the basin 95. A seal 305 or O-ring is positioned around the first fluid connector 275 to create a watertight seal. The first fluid connector 275 connects to a hose (not shown) extending from the outlet of the motorized pump 30. The example electrical connector 285 is also positioned on the sidewall 300 of the basin 95 adjacent to the first fluid connector 275. The electrical connector 285 extends through a second hole or aperture 317 of the sidewall 300. A seal 320 or O-ring is positioned around the electrical connector 285 to create a watertight seal. The electrical connector 285 provides power to the motorized pump 30 and level sensor 105 via one or more watertight wire conduits. The motorized pump 30 and level sensor 105 may also provide feedback to a control circuit or circuit board 335 (shown in FIG. 8) via the electrical connector 285.

Figure 7:
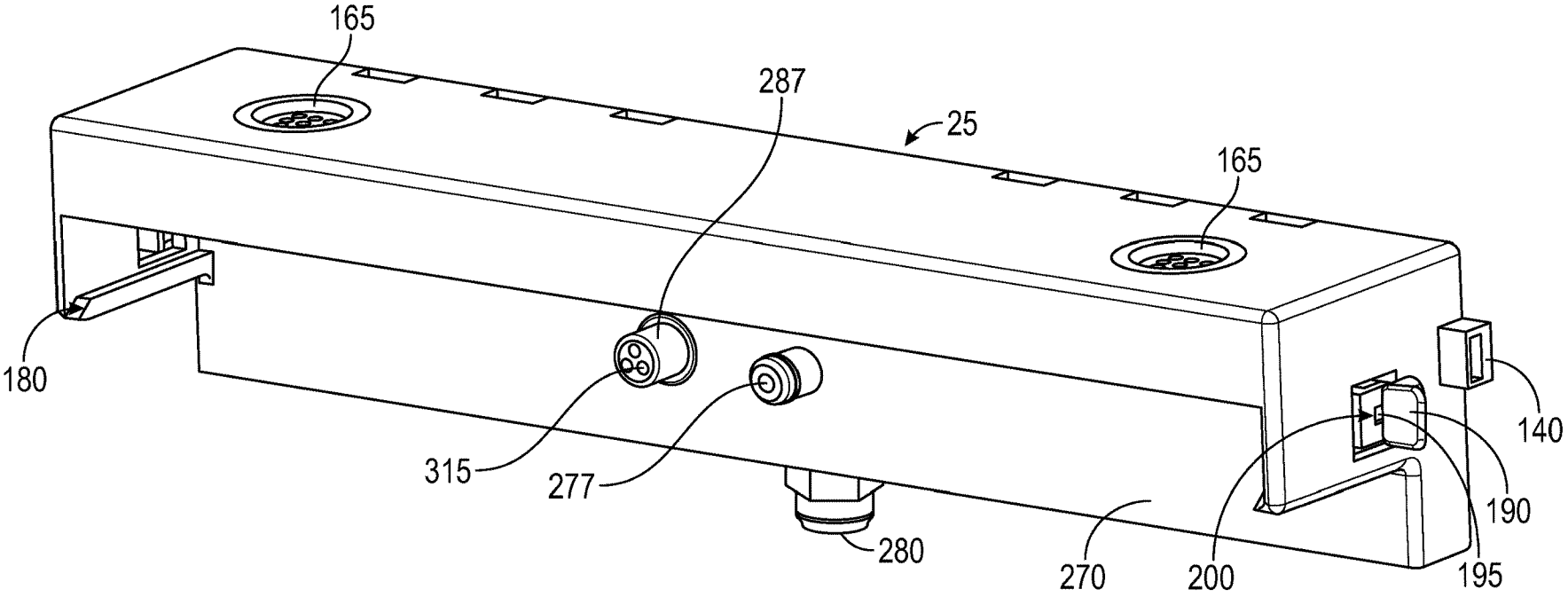
FIG. 7 depicts an alternative view of the example control housing assembly of FIGS. 2-5.

FIGS. 7 and 8 depict a more detailed view of the example control housing assembly 25. In particular, FIG. 7 depicts a side 270 of the control housing assembly 25 that is in contact with the tank assembly 20. The control housing assembly 25 includes a fluid port 277, a second fluid connector 280, and an electrical port 287. The first fluid connector 275 corresponds with the fluid port 277 to couple the first fluid connector 275 to the control housing assembly 25. The example second fluid connector 280 is fluidly coupled to the first fluid connector 275 through a channel 310 or opening (see FIG. 8) in the control housing assembly 25. The hose 65 extending between the control housing assembly 25 and the sprayer 15 is coupled to the second fluid connector 280. The example hose 65 is a quick-connect/disconnect hose, which allows for easy separation and connection of the sprayer 15 to the control housing 25, for example, when waste bucket maintenance is needed. Thus, the outlet of the pump 30 is fluidly connected to the sprayer 15 via a flow path created by the hoses 65 and the first and second fluid connectors 275, 280. In the illustrated example, a solenoid 312 (shown in FIG. 8) is positioned in the control housing assembly 25 adjacent to the channel 310 to prevent backflow after the pump 30 is deactivated to prevent a siphoning effect. More specifically, the solenoid 312 is electrically activated to serve as a valve to stop the siphoning effect of water once the user shuts off the active water flow. The example solenoid 312 may also control the flowrate or pressure of the fluid flowing through the flow path. Additionally or alternatively, a valve may be positioned along the flow path, such as between the first and second fluid connectors 275, 280, to control the flow (e.g., pressure) of fluid along the flow path. Additionally, the flow of fluid along the flow path is controlled by turning the pump 30 on or off.

As shown in FIG. 7, a first end 315 of the example electrical port 287 extends from the side 270 of the control housing assembly 25 and is coupled to the corresponding electrical connector 285. A second end 330 of the electrical port 287 is positioned within the control housing assembly 25 and is accessible when the back cover 130 of the control housing assembly 25 is removed, as shown in FIG. 8.

As shown in FIG. 8, the example electronic control system 35 includes a circuit board 335 positioned in the control housing assembly 25. The example circuit board 335 is electrically coupled to the motorized pump 30 and level sensor 105 via the electrical connector 285 and to the two ports 165 positioned on the top 160 of the control housing assembly 25. A battery compartment 340 is also disposed in the control housing assembly 25. The battery compartment 340 may be sized to house any suitable type of and number of batteries 345. In some examples, disposable dry-cell batteries may be used. Alternatively, rechargeable batteries or lithium-ion batteries may be used. The example battery compartment 340 includes a cover 350 on a side of the control housing assembly 25 so that the batteries 345 may be accessible and replaceable without removing the back cover 130 of the control housing assembly 25. The example batteries 345 and battery compartment 340 are also electrically coupled to the example circuit board 335.

Figure 9:
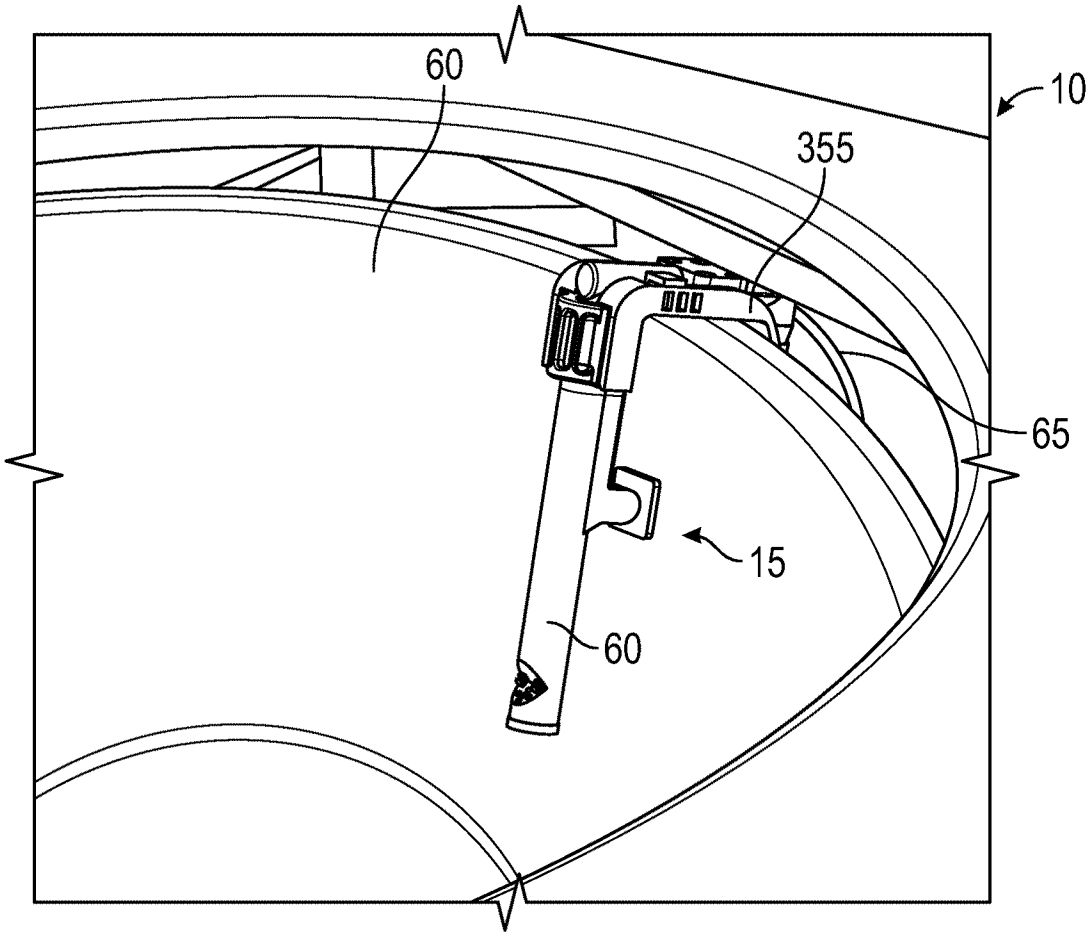
FIG. 9 depicts an example nozzle that may be used with the example commode bidet of FIG. 1.
Figure 11:
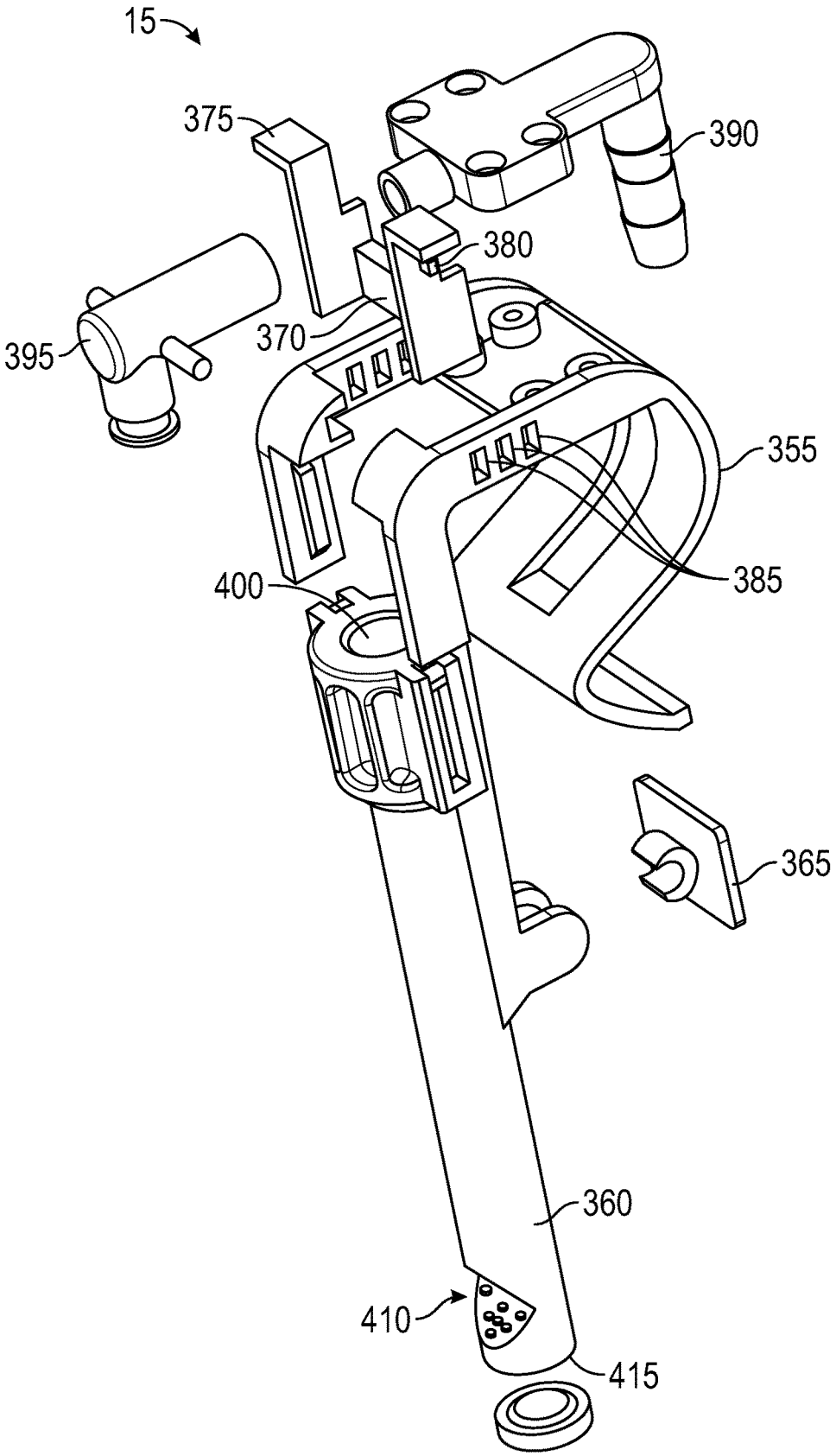
FIG. 11 depicts an exploded view of the example nozzle of FIGS. 9 and 10.

FIG. 9 depicts an example sprayer 15 that is connected to the bucket 60 of the example bidet 10. FIGS. 10-13 depict more detailed views of the example sprayer 15. As with the components of the bracket 115 disposed within the basin 95, the components of the sprayer 15 may be snap-fit or press-fit together for ease of assembly. The example construction includes a clip portion 355 or attachment device and a sprayer wand portion 360. The example clip 355 is an S-clip. Advantageously, the S-clip allows quick attachment and removal from the waste bucket and includes minimal components for ease of cleaning. However, the clip portion 355 may be shaped in any configuration to fit a lip of the bucket 60. The combination of the s-clip 355 and a pivot foot 365 facilitate the clipping of the sprayer 15 onto the bucket 60. The pivot foot 365 of the example construction is pivotably coupled to the sprayer wand 360. An adjuster 370 can be moved to one of three different positions to adjust the angle or placement of the sprayer wand 360 as needed based on the needs of the user. The adjuster 370 includes two flanges 375 on either side that may be squeezed toward each other to enable the user to slide the adjuster 370 between the three different positions. When the flanges 375 are released, protrusions 380 on the adjuster 370 snap into place in one of three openings 385 on either side of the S-clip 355.

A hose connector 390 fluidly couples the hose 65 extending from the control housing 25 and the sprayer 15. The hose connector 390 is fluidly coupled to a quick connector 395. The example quick connector 395 couples the sprayer wand 360 to the clip portion 355. The quick connector 395 is disposed within an opening 400 of the sprayer wand 360 to fluidly couple the wand 360 to hose connector 390. The quick connector 395 is sized such that the fit is tight and water-tight with an O-ring 405 of the opening 400. The O-ring 405 is disposed in the opening 400 to seal the water channel between the sprayer wand 360 and the water channel in the clip assembly 355. The sprayer wand 360 has an outlet 410 adjacent a distal end 415. Water is sprayed from the outlet 410 to clean perineal area of the user. In some examples, the sprayer wand portion 360 is disposable to make cleaning easier or make changing the sprayer 15 between patients easier and more sanitary.

Figure 13:
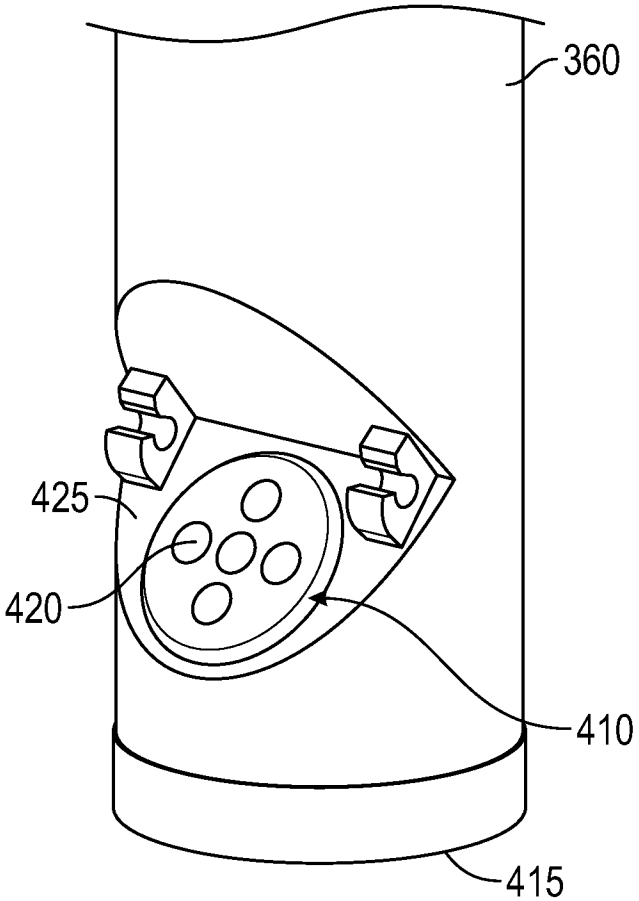
FIG. 13 depicts a more detailed view of an example outlet of the example nozzle of FIGS. 9-12.
Figure 12:
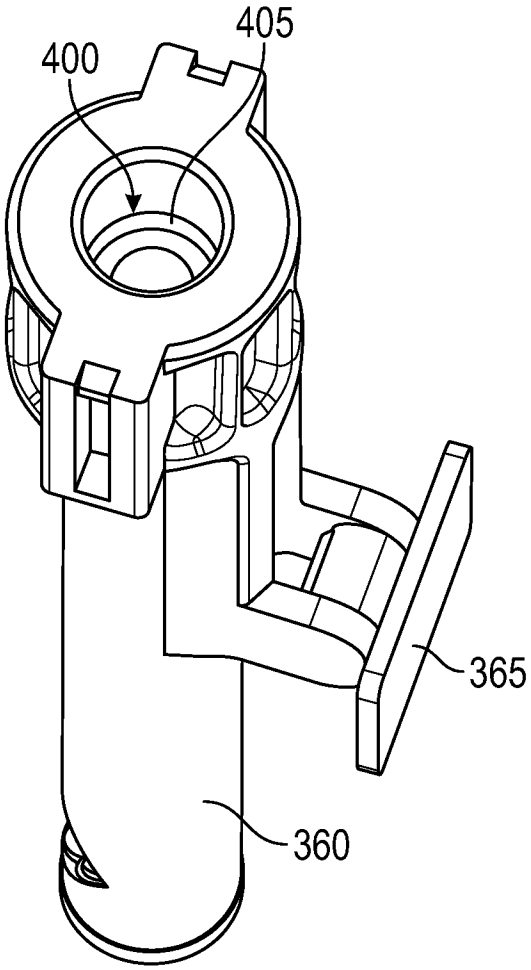
FIG. 12 depicts a more detailed view of an example sprayer wand of the example nozzle of FIGS. 9-11.

FIG. 13 depicts a detailed view of the outlet 410. In the example construction, the outlet 410 having a plurality of openings 420 positioned on a surface 425 that is angled upward. In some examples, a flap or cover (not shown) may be positioned over the outlet 410 and rotatable away from the outlet 410 as a result of the water pressure through the outlet 410. In such cases, there may be a spring member that biases the flap closed when there is no water pressure keeping it open, or insufficient water pressure to overcome the biased force of the spring member.

Figure 14:
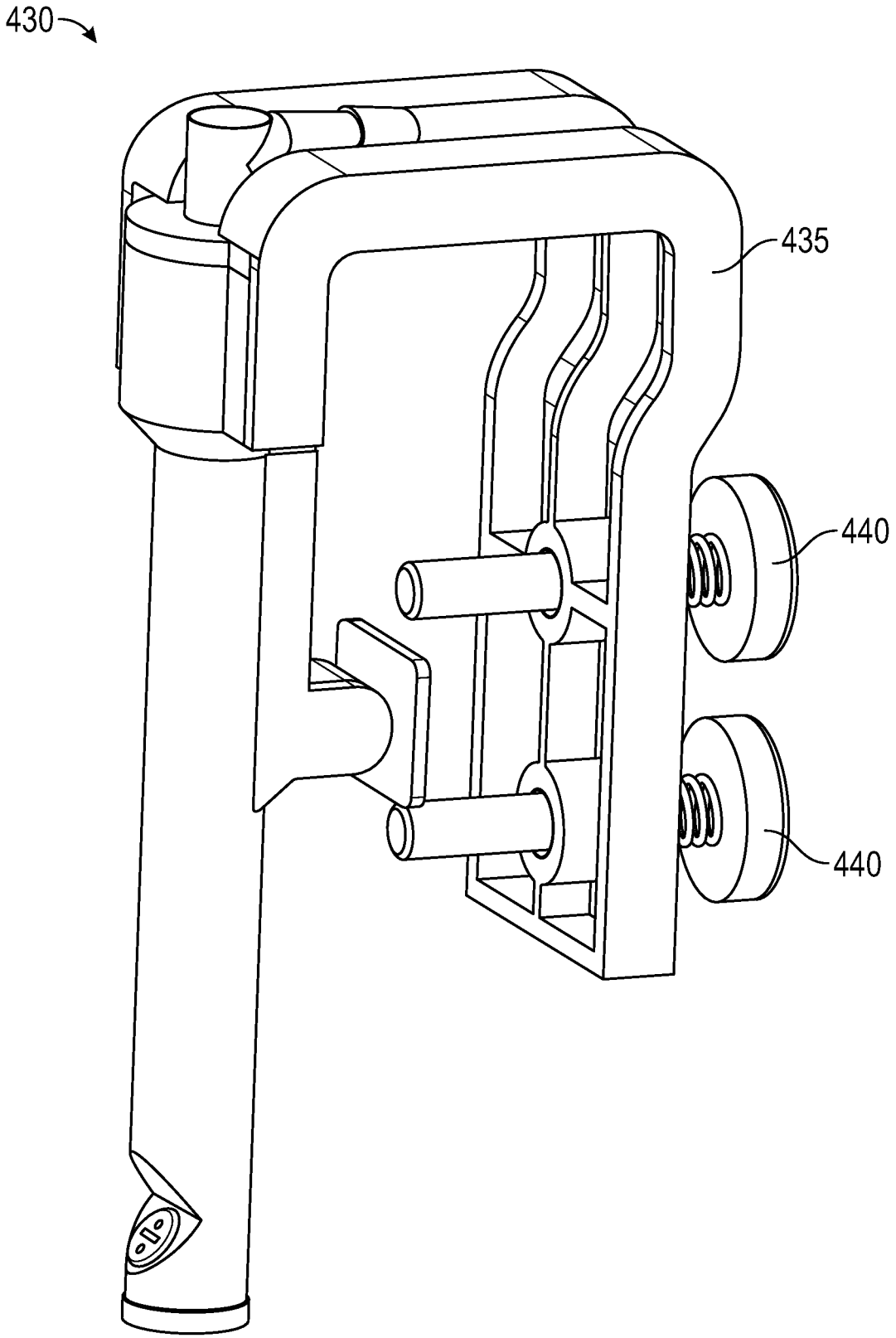
FIG. 14 depicts an alternative example nozzle that may be used with the example commode bidet of FIG. 1.

FIG. 14 depicts an alternative construction of an example sprayer 430. The sprayer wand 360 is substantially the same. However, the sprayer 430 is connected with a u-shaped bracket 435 and a number of tensioning devices 440 or bolts to secure the sprayer 430 to the bucket of the commode. The example construction of FIG. 14 may be more suited to adjust to different styles or types of portable commodes.

One or more of the disclosed embodiments, alone or in combination, may provide one or more technical effects including enabling a low-mobility person to easily clean their perineal area while using a portable commode. The disclosed designs enable the use of a bidet with a portable commode. Accordingly, the disclosed bidet designs may offer improved portability and versatility compared to other bidet designs. The technical effects and technical problems in the specification are exemplary and are not limiting. It should be noted that the embodiments described in the specification may have other technical effects and can solve other technical problems.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only, and not limiting. Although only a few embodiments have been described in detail in this disclosure, those skilled in the art who review this disclosure will readily appreciate that many various alternatives, modifications, variations, improvements and/or substantial equivalents, whether known or that are or may be presently foreseen, are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes, and omissions may be made in the design, operating conditions, and arrangement of the various examples of embodiments without departing from the spirit or scope of the present inventions. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A bidet for a portable commode comprising a frame having one or more armrest portions, the bidet comprising:
- a sprayer coupled to a bucket of the portable commode;
- a water basin fluidly coupled to the sprayer;
- an electrically motorized pump disposed in the water basin to pump water from the basin to the sprayer;
- a control module to control a flow of water from the basin to the sprayer; and
- a control housing assembly coupled to the water basin and the control module, the control housing assembly further comprising a fastening mechanism removably affixing the control housing assembly to the one or more armrest portions of the frame.

2. The bidet of claim 1, further comprising a level sensor disposed in the water basin to detect when a level of the water is too low to operate the pump.

3. The bidet of claim 1, further comprising a power source.

4. The bidet of claim 3, wherein the power source includes a battery.

5. The bidet of claim 3, wherein the power source includes an AC adapter.

6. The bidet of claim 5, wherein the AC adapter is coupled to the control housing assembly using a first port, the control housing assembly further includes a second port in which the control module is connected, wherein the first and second ports are identical such that the AC adapter and the control module are interchangeable between the first and second port.

7. The bidet of claim 1, wherein the control module includes a switch to turn the motorized pump on or off.

8. The bidet of claim 1, wherein the control module includes an incremental adjuster to adjust a pressure of water flowing through the sprayer.

9. The bidet of claim 1, further comprising extendable support aims that extend from a housing to stabilize the water basin relative to the portable commode.

10. The bidet of claim 1, wherein the fastening mechanism comprises straps.

11. A sprayer assembly for a portable bidet comprising:
- a clip having three openings on each of a first and second side;
- a sprayer wand extending into the bucket of the portable commode, the sprayer wand having an outlet for water;
- an adjuster to adjust either or both of the placement and angle of the sprayer wand, the adjuster further comprising a flange on each of a first and second side, each flange being removably inserted into a corresponding opening of the clip; and
- a hose extending between the sprayer assembly and a control housing assembly, the control housing assembly coupled to a water basin and a control module and further comprising a fastening mechanism removably affixing the control housing assembly to a frame of the portable commode.

12. The sprayer of claim 11, wherein the clip is an s-clip.

13. The sprayer of claim 11, further including a pivot foot attached to the sprayer wand to facilitate coupling the sprayer to the bucket.

14. The sprayer of claim 11, further including a quick connector to couple the sprayer wand to the sprayer.

15. The sprayer of claim 14, wherein the sprayer wand is removable from the sprayer.

16. The sprayer of claim 15, wherein the sprayer wand is disposable.

17. The sprayer of claim 11, further including a hose connector to connect the sprayer to a water source.

18. The sprayer of claim 17, wherein the water source is a portable water basin.

* * * * *